United States Patent [19]

Boomer

[11] Patent Number: 4,749,180

[45] Date of Patent: Jun. 7, 1988

[54] MECHANICAL SURF BOARD

[76] Inventor: Ted Boomer, 911 Walker Road, Windsor, Ontario, Canada, N8Y 2Z5

[21] Appl. No.: 58,234

[22] Filed: Jun. 4, 1987

[51] Int. Cl.[4] ..... A63B 69/18

[52] U.S. Cl. ..... 272/17; 272/1 B; 272/54; 272/97; 272/146; 434/247

[58] Field of Search ..... 272/1 B, 1 C, 16, 17, 272/18, 54, 93, 97, 144, 146; 434/247; 5/61, 62, 108, 109

[56] References Cited

U.S. PATENT DOCUMENTS

| | | | |
|---|---|---|---|
| 872,627 | 12/1907 | Keen | 272/17 |
| 1,789,680 | 1/1931 | Gwinnett | 272/18 |
| 2,524,238 | 10/1950 | Soule | 272/1 C |
| 2,531,858 | 11/1950 | Miller | 5/109 |
| 2,661,954 | 12/1953 | Koci | 272/1 C X |
| 3,378,859 | 4/1968 | Parker | 5/109 |
| 3,863,915 | 2/1975 | Pifer | 272/1 B X |
| 4,478,407 | 10/1984 | Manabe | 272/18 |
| 4,645,202 | 2/1987 | Tomba et al. | 272/97 |

FOREIGN PATENT DOCUMENTS

| | | | |
|---|---|---|---|
| 425723 | 10/1947 | Italy | 272/18 |

*Primary Examiner*—David A. Scherbel
*Assistant Examiner*—Richard E. Chilcot, Jr.
*Attorney, Agent, or Firm*—Barnes, Kisselle, Raisch, Choate, Whittemore & Hulbert

[57] ABSTRACT

A mechanical surf board and an elongated support bar beneath the surf board to which the board is pivoted for transverse pivotal movement. The support bar is connected at one end to a power source for movement in a circular path about a transverse axis crosswise of the board. The other end of the support bar is pivotally connected to an upright support rod. The board is locked to the support bar in various positions of pivoted adjustment.

7 Claims, 2 Drawing Sheets

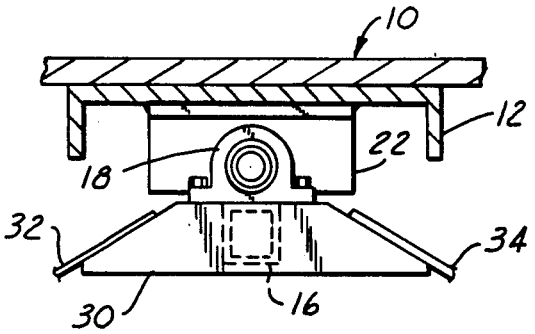
FIG.5
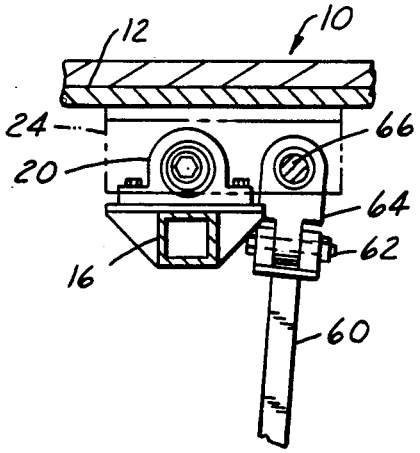
FIG.6
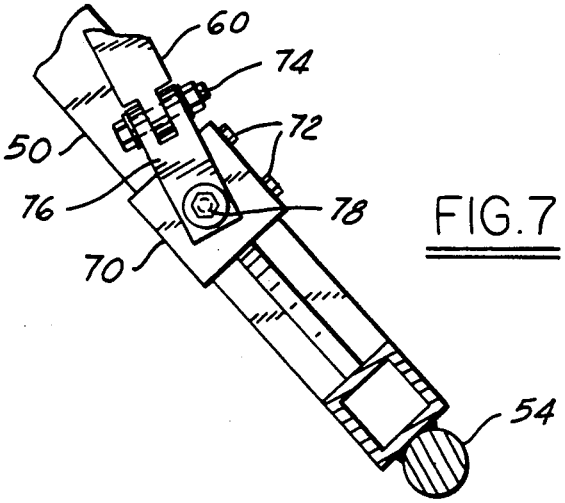
FIG.7
FIG.8
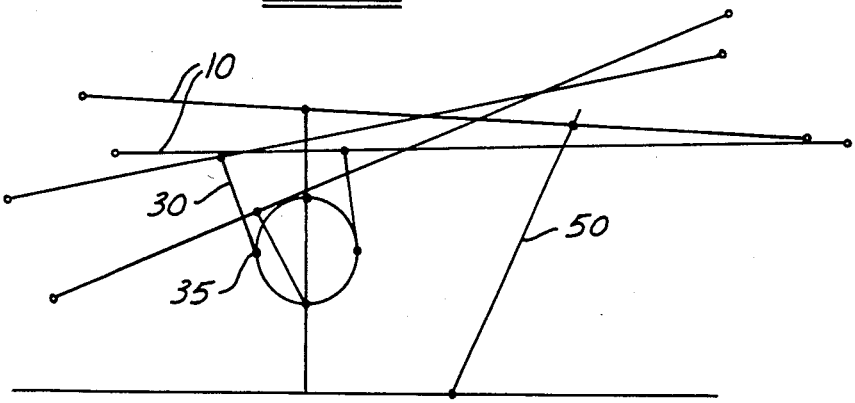

MECHANICAL SURF BOARD

This invention relates generally to a simulated surfing apparatus and refers more particularly to a mechanical surf board.

SUMMARY OF THE INVENTION

The mechanical surf board of this invention is intended for use primarily in places of entertainment and includes means for moving the board in such a manner as to simulate movement under actual surfing conditions.

In accordance with a specific embodiment of the invention, the surf board is mounted on a support bar for pivoted movement about a longitudinal axis and is locked in adjusted position. One end of the bar is moved in a circular path by a power source. The other end of the bar is supported by a pivoted, upright rod. The board simulates the movement of a surf board under actual surfing conditions when the power source is operated.

The means for locking the board in adjusted position on the bar preferably comprises a strut connected at one end to the board and at the other end to the rod. The locked position of the board may be changed either by adjusting the length of the strut or by connecting the strut to the rod at different points along the length of the rod.

By proper adjustment of the strut, it is possible to cause the board to oscillate about its longitudinal axis during operation of the power source.

These and other objects of the invention will become more apparent at the following description proceeds, especially when considered with the accompanying drawings.

BRIEF DESCRIPTION OF THE DRAWINGS

FIG. 5 is a sectional view taken on the line 5—5 in FIG. 2.

FIG. 6 is a sectional view taken on the line 6—6 in FIG. 2.

FIG. 7 is a sectional view taken on the line 7—7 in FIG. 3.

FIG. 8 is a diagrammatic view illustrating various positions of the board during operation.

DETAILED DESCRIPTION

Figure 1:
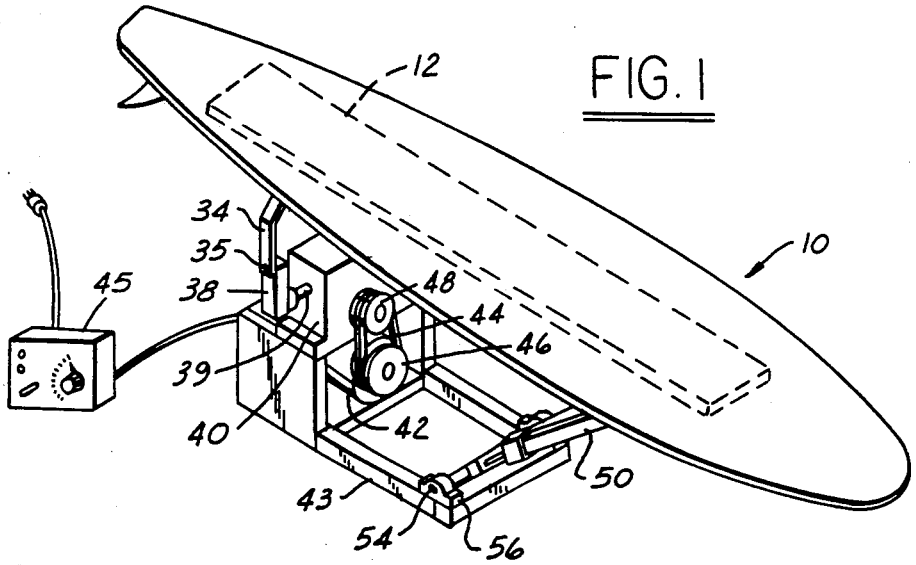
FIG. 1 is a perspective view of a simulated surfing apparatus constructed in accordance with the invention.
Figure 2:
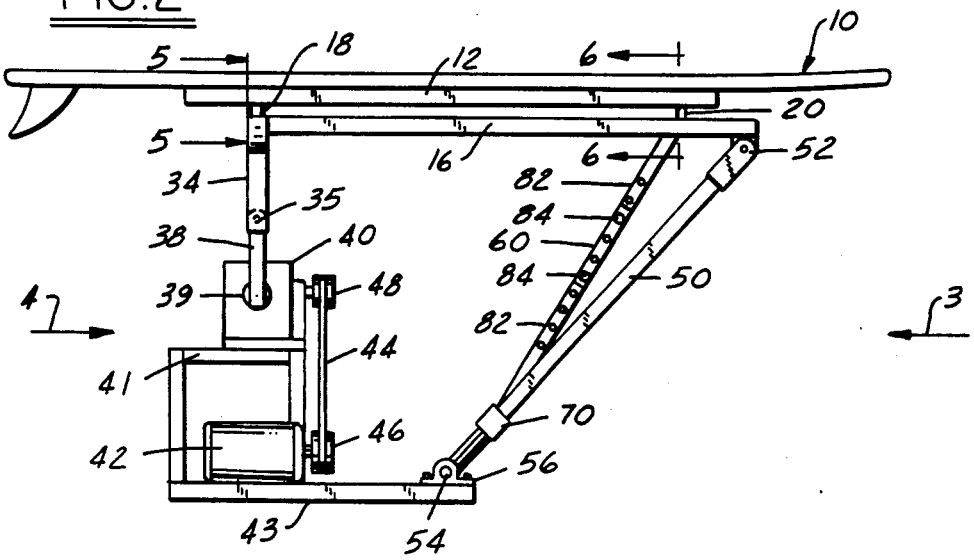
FIG. 2 is a side elevational view of the apparatus shown in FIG. 1.
Figure 4:
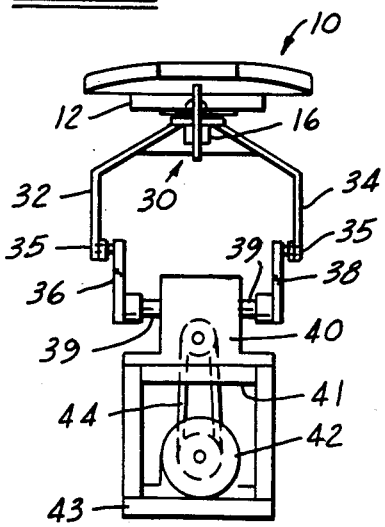
FIG. 4 is a view of the opposite end of the apparatus, looking in the direction of the arrow 4 in FIG. 2.
Figure 3:
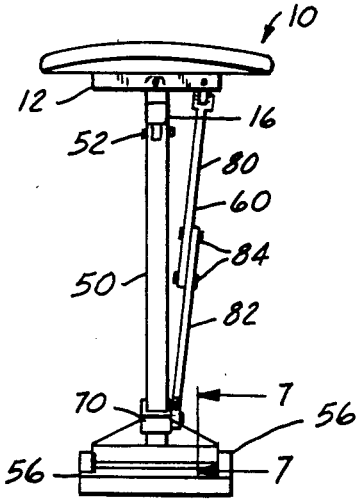
FIG. 3 is a view of one end of the apparatus, looking in the direction of the arrow 3 in FIG. 2.

Referring now more particularly to the drawings, the surf board is an elongated, generally flat member 10 having the configuration of a genuine surf board. It may, in fact, be a genuine surf board. A rectangular metal reinforcing frame 12 is secured to the bottom of the surf board 10.

An elongated support bar 16 extends beneath the board 10, lengthwise thereof. The surf board 10 is pivotally mounted on the support bar 16 by pillow blocks 18 and 20 rigidly mounted on the support bar 16 near its opposite ends. Block 18 is pivoted to a flange 22 of reinforcing frame 12 near one end of the frame, and block 20 is pivoted to a flange 24 near the other end. The axes of these pivots are aligned and extended longitudinally of the surf board so that the surf board may be pivoted or tilted to one side or the other.

A bracket 30 is rigidly attached to one end of the support bar 16. The bracket has spaced legs 32 and 34 which extend downwardly and have their lower ends pivoted at 35 to the ends of crank arms 36 and 38. The crank arms are connected to aligned crank shafts 39 which extend horizontally outwardly from opposite sides of a gear reducer 40. The gear reducer is mounted on a support 41 mounted on base 43. A variable speed electric motor 42 on base 43 drives the gear reducer 40 by means of a belt 44 extending over a pulley 46 on the output shaft of the motor and a pulley 48 on the gear reducer. The crank shafts 39 are aligned and extend at right angles to the length of the surf board 10 and support bar 16. A control box 45 is provided to turn the motor on and off and to regulate its speed.

An elongated, generally upright, support rod 50 has its upper end pivoted at 52 to the front end of the support bar 16. The lower end of rod 50 is pivoted at 54 to pillow blocks 56 on the base 43. Pivots 52 and 54 are parallel to crank shafts 39 and, therefore, extend at right angles to the length of the surf board 10 and support bar 16.

An elongated strut 60 is connected at its upper end to the surf board frame 12 and at its lower end to the rod 50. More specifically, a pin 62 pivots the upper end of strut 60 to a link 64 which is pivoted by pin 66 to flange 24 of frame 12. The axis of pin 66 extends lengthwise of the surf board. The axes of pins 66 and 68 are at right angles to the length of the strut and at right angles to each other. The lower end of strut 60 is connected to a collar 70 near the bottom of rod 50. The collar 70 is secured in adjusted position along the length of the rod 50 by bolts 72. A pin 74 pivots the lower end of strut 60 to a link 76 which is pivoted by pin 78 to collar 70. The axis of pin 78 is parallel to pivots 54. The axes of pins 74 and 78 are at right angles to the length of strut 60 and at right angles to each other.

The strut 60 is made of two overlapping sections 80 and 82 bolted together by bolts 84. The overlap of the sections can be varied to vary the length of the strut.

In use, the motor 40 is operated to rotate the pivoted connection between the crank arms 36, 38 and bracket legs 32, 34 in a circular path about a horizontal axis extending at right angles to the length of the board 10. The rear end of the board will follow a similar path, causing the support rod 50 to oscillate back and forth. By lengthening or shortening strut 60, or adjusting the position of collar 70 along rod 50, or both, the board 10 may be caused to oscillate about a longitudinal axis. Various positions of the board are shown in the diagrammatic view of FIG. 8. A person standing on the board will enjoy a ride closely simulating that experienced under actual surfing conditions.

I claim:

1. A mechanical surfing apparatus comprising an elongated surf board, means for supporting and moving said board in such a manner as to simulate movement under actual surfing conditions, said supporting and moving means comprising an elongated support beneath said surf board, means mounting said board on said support for transverse pivotal movement about a longitudinal axis, power means connected to said support adjacent one end thereof for moving the same in a circular path about a first transverse axis extending crosswise of said board, a generally upright rod pivoted at its upper end to said support adjacent the other end of said support on an axis parallel to said first transverse axis, said rod being pivoted at its lower end to a base on an axis parallel to said first transverse axis, and means for locking said board in adjusted position about said longitudinal axis.

2. A mechanical surfing apparatus comprising an elongated surf board, means for supporting and moving said board in such a manner as to simulate movement under actual surfing conditions, said supporting and moving means comprising an elongated bar extending beneath said surf board lengthwise thereof, means mounting said board on said bar for transverse pivotal movement about a longitudinal axis, a bracket rigid with and depending from said bar adjacent one end of said board, power means for moving said bracket in a circular path about a first transverse axis extending crosswise of said board, a generally upright rod pivoted at its upper end to said bar adjacent the other and of said bar on an axis parallel to said first transverse axis, said rod being pivoted at its lower end to a base on an axis parallel to said first transverse axis, and means for locking said board in adjusted position about said longitudinal axis.

3. A mechanical surfing apparatus as defined in claim 2, wherein said locking means comprises a strut having its upper end connected to said board and its other end connected to said rod.

4. A mechanical surfing apparatus as defined in claim 3, including means for adjusting the length of said strut.

5. A Mechanical surfing apparatus as defined in claim 3, including means for connecting said other end of said strut to said rod at selected points along the length of the latter.

6. A mechanical surfing apparatus as defined in claim 3, wherein the upper end of said strut is connected to said board for pivotal movement about two axes at right angles to said strut and at right angles to each other, and the other end of said strut is connected to said rod for pivotal movement about two axes at right angles to said strut and at right angles to each other.

7. A mechanical surfing apparatus as defined in claim 6, wherein said strut is made of two overlapping sections of the strut to be varied, and a collar connecting said other end of said strut to said rod at selected points along the length of the latter.

* * * * *